US009051941B2

(12) United States Patent
Kojima et al.

(10) Patent No.: US 9,051,941 B2
(45) Date of Patent: Jun. 9, 2015

(54) AXIAL-FLOW FAN

(71) Applicant: DAIKIN INDUSTRIES, LTD., Osaka-shi, Osaka (JP)

(72) Inventors: Azumi Kojima, Sakai (JP); Yuuta Yokoyama, Kyoto (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/367,760

(22) PCT Filed: Dec. 26, 2012

(86) PCT No.: PCT/JP2012/083577
§ 371 (c)(1),
(2) Date: Jun. 20, 2014

(87) PCT Pub. No.: WO2013/099906
PCT Pub. Date: Jul. 4, 2013

(65) Prior Publication Data

US 2014/0363306 A1 Dec. 11, 2014

(30) Foreign Application Priority Data

Dec. 28, 2011 (JP) ..... 2011-288207

(51) Int. Cl.
*F04D 19/00* (2006.01)
*F04D 29/38* (2006.01)

(52) U.S. Cl.
CPC ..... *F04D 29/384* (2013.01); *F04D 19/002* (2013.01)

(58) Field of Classification Search
USPC ..... 416/231 B, 236 A
See application file for complete search history.

(56) References Cited

U.S. PATENT DOCUMENTS

| | | | | |
|---|---|---|---|---|
| 4,089,618 | A * | 5/1978 | Patel | 416/228 |
| 4,214,426 | A * | 7/1980 | Lindblad | 56/295 |
| 5,104,291 | A * | 4/1992 | Morrison | 416/168 R |
| 5,603,607 | A * | 2/1997 | Kondo et al. | 416/228 |
| 6,779,978 | B2 * | 8/2004 | Camargo Do Amarante | 416/228 |
| 7,029,229 | B2 * | 4/2006 | Iwase et al. | 415/1 |
| 2004/0136830 | A1 | 7/2004 | Eguchi et al. | |
| 2007/0031250 | A1 | 2/2007 | Suzuki et al. | |
| 2011/0008170 | A1 | 1/2011 | Suzuki et al. | |

FOREIGN PATENT DOCUMENTS

| | | | |
|---|---|---|---|
| EP | 0 711 925 | A1 | 10/1995 |
| JP | 2003-206894 | A | 7/2003 |
| JP | 2007-40202 | A | 2/2007 |
| KR | 20030090806 | A | 11/2003 |
| WO | 2010/103797 | A1 | 9/2010 |

OTHER PUBLICATIONS

International Search Report of corresponding PCT Application No. PCT/JP2012/083577.

(Continued)

*Primary Examiner* — Nathaniel Wiehe
*Assistant Examiner* — Michael Sehn
(74) *Attorney, Agent, or Firm* — Global IP Counselors

(57) ABSTRACT

An axial-flow fan has a blade with a recessed part that is recessed toward a front edge formed in a rear edge of the blade. A rounded stress-relieving part is formed in a positive pressure surface side and a negative pressure surface side of a front-edge-side edge part of the recessed part as seen in a cross-sectional view of the blade.

10 Claims, 8 Drawing Sheets

(56) References Cited

OTHER PUBLICATIONS

European Search Report of corresponding EP Application No. 12 86 3666.9 dated Oct. 30, 2014.

Machine Design Theory and Practice, cited by Korean Patent Office.

International Preliminary Report of corresponding PCT Application No. PCT/JP2012/083577 dated Jul. 10, 2014.

* cited by examiner

AXIAL-FLOW FAN

CROSS-REFERENCE TO RELATED APPLICATIONS

This U.S. National stage application claims priority under 35 U.S.C. §119(a) to Japanese Patent Application No. 2011-288207, filed in Japan on Dec. 28, 2011, the entire contents of which are hereby incorporated herein by reference.

TECHNICAL FIELD

The present invention relates to an axial-flow fan, and particularly relates to an axial-flow fan having blades in which recessed parts that are recessed toward the front edges are formed in the rear edges.

BACKGROUND ART

In the past, there have been axial-flow fans having blades in which recessed parts that are recessed toward the front edges are formed in the rear edges, such as the one shown in Patent Literature 1 (Japanese Laid-open Patent Application No. 2003-206894).

SUMMARY

In an axial-flow fan, centrifugal force during rotation causes deformation such that the blades stretch toward the outer perimeter. At such times, stress readily concentrates in the recessed parts in a conventional axial-flow fan in which recessed parts are formed in the blades.

An object of the present invention is to minimize stress concentration in the recessed parts in an axial-flow fan having blades in which recessed parts that are recessed toward the front edges are formed in the rear edges.

An axial-flow fan according to a first aspect is an axial-flow fan having a blade in which a recessed part recessed toward a front edge is formed in a rear edge, wherein a rounded stress-relieving part is formed in a positive pressure surface side and a negative pressure surface side of a front-edge-side edge part of the recessed part in a cross-sectional view of the blade.

An axial-flow fan according to a second aspect is the axial-flow fan according to the first aspect, wherein the stress-relieving part has a rounded shape with a radius of 1 mm or greater.

An axial-flow fan according to a third aspect is the axial-flow fan according to the first or second aspect, wherein the recessed part is a V-shaped recess.

The portions in the recessed parts where stress concentrates the most readily are front-edge-side edge parts. Therefore, it is most effective to relieve stress in the front-edge-side edge parts in order to minimize stress concentration in the recessed parts.

In view of this, in this axial-flow fan, rounded stress-relieving parts are formed in the positive pressure surface sides and the negative pressure surface sides of the front-edge-side edge parts of the recessed parts in a cross-sectional view of the blades, as described above.

It is thereby possible in this axial-flow fan to relieve stress in the front-edge-side edge parts of the recessed parts, and to minimize stress concentration in the recessed parts.

An axial-flow fan according to a fourth aspect is the axial-flow fan according to the third aspect, wherein in viewing the blade from above, the recessed part has two linear parts leading from the rear edge toward the front edge of the blade, and a curved part joining end parts together in front edges of the two linear parts; and the front-edge-side edge part is the curved part.

In this axial-flow fan, the stress-relieving parts are formed in the curved parts where stress concentrates the most readily in the V-shaped recessed parts.

It is thereby possible in this axial-flow fan to effectively minimize stress concentration in the V-shaped recessed parts.

An axial-flow fan according to a fifth aspect is the axial-flow fan according to the fourth aspect, wherein the curved part has a rounded shape with a radius of 8 mm or greater when the blade is viewed from above.

In this axial-flow fan, because the rounded shapes of the curved parts as the front-edge-side edge parts have a radius of 8 mm or greater in a plan view of the blades, the stress in the front-edge-side edge parts can be further relieved, and the stress concentration in the recessed parts can be further minimized.

DESCRIPTION OF EMBODIMENTS

An embodiment of the axial-flow fan according to the present invention is described below based on the accompanying drawings. The specific configuration of the axial-flow fan according to the present invention is not limited to the embodiment below, and modifications are possible within a scope not deviating from the main point of the present invention. In the description below, an example in which the present invention is applied to an axial-flow fan configuring an outdoor unit is described, but the present invention is not limited to this; it may be applied to an axial-flow fan for another use.

(1) Overall Configuration of the Outdoor Unit

Figure 1:
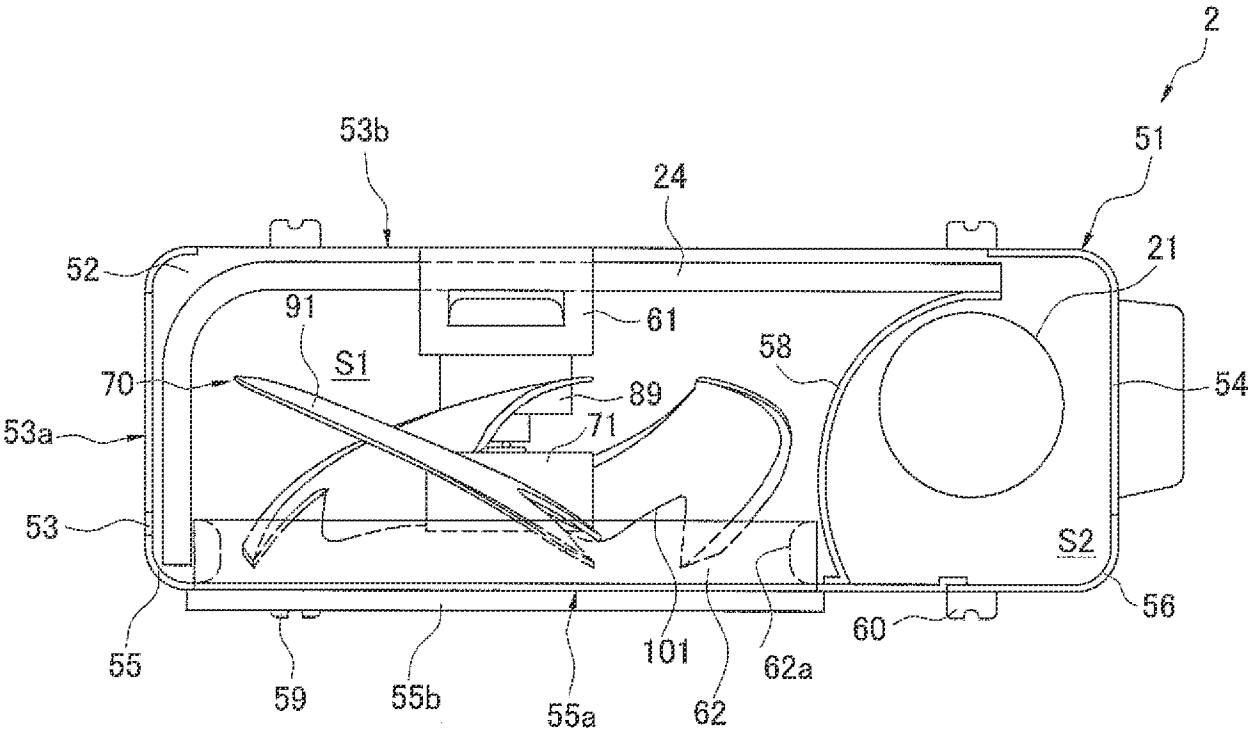
FIG. 1 is a plan view showing a state in which a ceiling plate has been removed from an outdoor unit in which an outdoor fan is used as an axial-flow fan according to an embodiment of the present invention.
Figure 2:
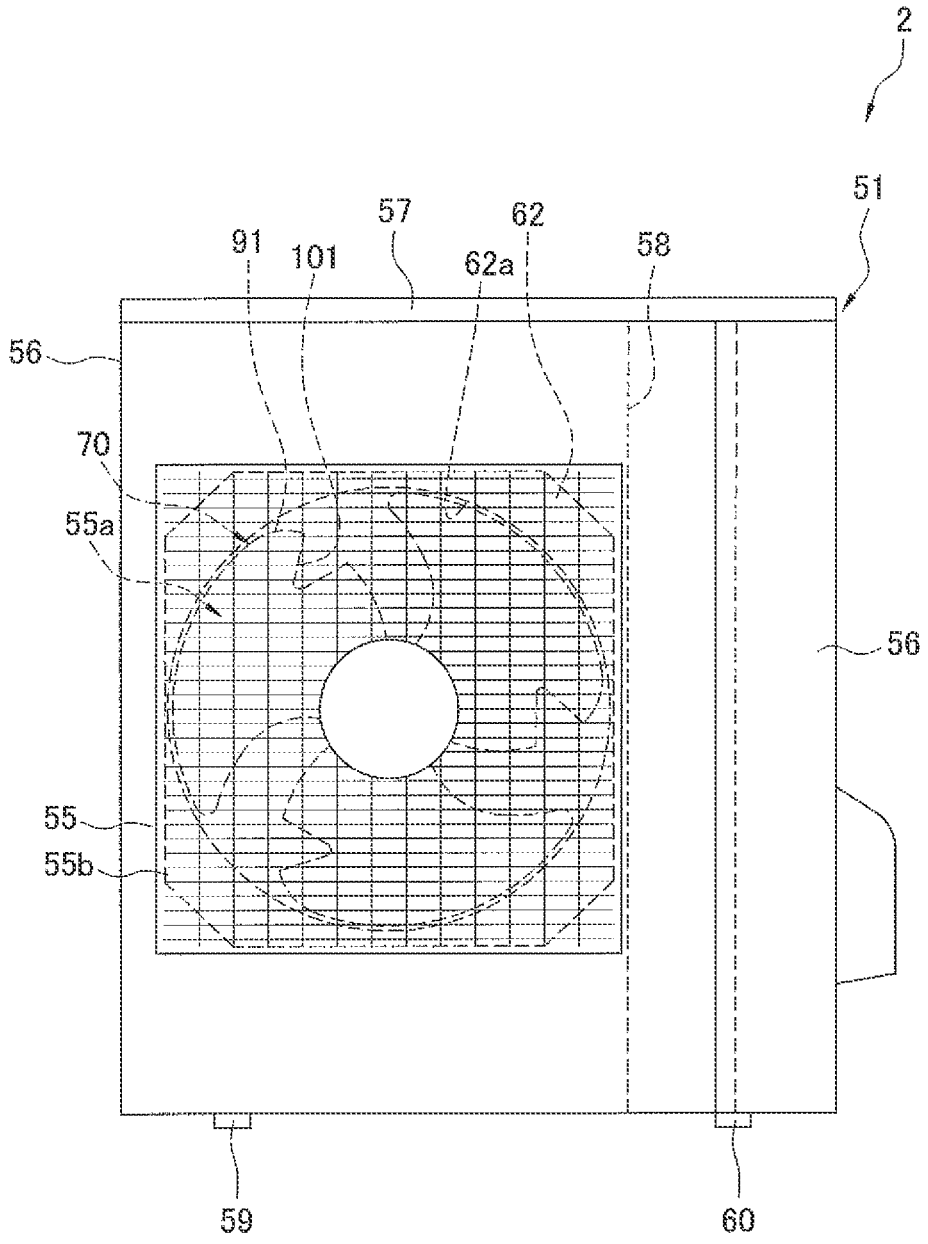
FIG. 2 is a front view of the outdoor unit in which the outdoor fan according to an embodiment of the present invention is used.

FIGS. 1 and 2 are drawings illustrating an outdoor unit 2 of an air conditioning apparatus in which is adopted an outdoor fan 70 as an axial-flow fan according to one embodiment of the present invention. Here, FIG. 1 is a plan view of the outdoor unit 2 in a condition having removed a ceiling plate 57. FIG. 2 is a front view of the outdoor unit 2. In the description below, words expressing directions and/or faces including "up," "down," "left," and "right," and/or "front face,"

"side face," "back face," "top face," and "bottom face," unless otherwise specified, signify directions and/or faces in the case of regarding the outdoor unit 2 illustrated in FIG. 2 as a front face.

The outdoor unit 2 has a structure (so called "trunk-type" structure), in which an internal space of a unit casing 51 is divided into left and right by a partitioning plate 58 extending in a vertical direction, whereby a blower compartment S1 and a machine compartment S2 are formed. The outdoor unit 2 is configured so that outside air is taken into the unit casing 51 from a hack face and one part of a side face of the unit casing 51 and the outside air is blown out from a front face of the unit casing 51. The outdoor unit 2 mainly has the unit casing 51, refrigerant circuit-configuring parts including a compressor 21, an outdoor heat exchanger 24, and refrigerant pipes connecting these machines, an outdoor fan 70 (axial-flow fan), and a bell mouth 80. Here, an example is described, in which the blower compartment S1 is formed toward a left side face of the unit casing 51 and the machine compartment S2 is formed toward a right side face of the unit casing 51, but left and right may be reversed.

The unit casing 51 is formed in a roughly rectangular parallelepiped form, and mainly houses the refrigerant circuit-configuring parts including the compressor 21, the outdoor heat exchanger 24, and refrigerant pipes connecting these machines, and the outdoor fan 70. The unit casing 51 has a floor plate 52, a blower compartment-side side plate 53, a machine compartment-side side part 54, a blower compartment-side front plate 55, a machine compartment-side front plate 56, and a ceiling plate 57.

The floor plate 52 is a metal plate-form member configuring a bottom face of the unit casing 51. Two foundation legs 59 and 60 fixed to a site installation surface are provided beneath the floor plate 52.

The blower compartment-side side plate 53 is a metal plate-form member configuring a side face portion toward the blower compartment S1 of the unit casing 51. A lower part of the blower compartment-side side plate 53 is fixed to the floor plate 52. An intake port 53*a* for outside air taken into the unit casing 51 by the outdoor fan 70 is formed on the blower compartment-side side plate 53.

The machine compartment-side side plate 54 is a metal plate-form member configuring one part of a side face portion toward the machine compartment S2 of the unit casing 51 and a back face portion toward the machine compartment S2 of the unit casing 51. A lower part of the machine compartment-side side plate 54 is fixed to the floor plate 52. Here, the machine compartment-side side plate 54 covers a portion toward the back face of the side face of the machine compartment S2. An intake port 53*b* for outside air taken into the unit casing 51 by the outdoor fan 70 is formed between an end part on the back face side of the blower compartment-side side plate 53 and an end part on the blower compartment S1 side of the machine compartment-side side plate 54.

The blower compartment-side front plate 55 is a metal plate-form member configuring a front face portion of the blower compartment S1 of the unit casing 51 and one part of a front face portion of the machine compartment S2 of the unit casing 51. A blow-out port 55*a* for blowing out outside air taken into the unit casing 51 to the outside by the outdoor fan 70 is provided on the blower compartment-side front plate 55. A front side of the blow-out port 55*a* is covered by a fan grill 55*b*. A lower part of the blower compartment-side front plate 55 is fixed to the floor plate 52, and an end part on the left side face side thereof is fixed to an end part on the front face side of the blower compartment-side side plate 53.

The machine compartment-side front plate 56 is a metal plate-form member that is removed during test running and/or maintenance in order to access the machine compartment S2 from the front face side of the unit casing 51 and perform inspection, and the like, of the machines disposed inside the machine compartment S2. The machine compartment-side front plate 56 is a metal plate-form member configuring one part of a front face portion of the machine compartment S2 of the unit casing 51 and one part of a side face portion of the machine compartment S2 of the unit casing 51. An end part on the blower compartment S1 side of the machine compartment-side front plate 56 is fixed to an end part on the machine compartment S2 side of the blower compartment-side front plate 55, and an end part on a back face side thereof is fixed to an end part on the front face side of the machine compartment-side side plate 54. Here, one part of the front face portion of the machine compartment S2 of the unit casing 51 is configured by the blower compartment-side front plate 55, but that part may be configured by the machine compartment-side front plate 56. The blower compartment-side front plate 55 and the machine compartment-side front plate 56 also may be an integrated member.

The ceiling plate 57 is a metal plate-form member configuring a top face portion of the unit casing 51. The ceiling plate 57 is fixed to the blower compartment-side side plate 53, the machine compartment-side side plate 54, and the blower compartment-side front plate 55.

The partitioning plate 58 is a metal plate-form member being disposed on the floor plate 52 and extending in a vertical direction. The partitioning plate 58 divides the internal space of the unit casing 51 into left and right to form the blower compartment S1 toward the left side face and the machine compartment S2 toward the right side face. The partitioning plate 58 has a shape that is curved so that a central portion in a front-to-back direction thereof projects toward the blower compartment S1 side. A lower part of the partitioning plate 58 is fixed to the floor plate 52, an end part on a front face side thereof is fixed to the blower compartment-side front plate 55, and an end part on a back face side thereof is fixed to an end part on the machine compartment S2 side of the outdoor heat exchanger 24.

The outdoor fan 70 is a propeller type axial-flow fan mainly with which a hub 71 and a plurality of (here, three) blades 91 are integrally resin-molded, the plurality of blades 91 being formed so as to project from an outer perimeter edge of the hub 71. The outdoor fan 70 is provided so as to face opposite the front face of the unit casing 51 inside the blower compartment S1. More specifically, the outdoor fan 70 is provided so as to face opposite the blow-out port 55*a* formed on the blower compartment-side front plate 55 in a position on the front face side of the outdoor heat exchanger 24. Here, a recessed part 101 recessed toward a front edge side of the blade 91 is formed in a rear edge of the blade 91, for the purpose of improvement of ventilating performance and/or suppression of noise. The outdoor fan 70 is driven to rotate by a fan motor 89 disposed between the outdoor fan 70 and the outdoor heat exchanger 24 in the front-to-back direction. The fan motor 89 is supported by a fan motor mount 61 extending in a vertical direction between the ceiling plate 57 and the floor plate 52. A detailed configuration of the outdoor fan is to be described.

The bell mouth 62 is a member having a bell-shaped opening 62*a* having an open center, and is provided on the outer perimeter side of the outdoor fan 70. That is, the bell mouth 62 is provided so as to face opposite the front face of the unit casing 51 in the same manner as the outdoor fan 70 inside the blower compartment S1, and the outer perimeter of the outdoor fan 70 is surrounded by the opening 62*a*. The bell mouth 62 is fixed to the front face of the unit casing 51. A portion of the bell mouth 62 toward the blower compartment-side side plate 53 is disposed proximally to a front-side end of the outdoor heat exchanger 24. A portion of the bell mouth 62 toward the machine compartment S1 is disposed proximally to the partitioning plate 58.

The outdoor heat exchanger 24 is a roughly L-shaped heat exchanger panel, and is disposed on the floor plate 52 so as to follow the left side face and the back face of the unit casing 51 inside the blower compartment S1.

The compressor 21 is a sealed-type compressor having an upright cylindrical shape, and is disposed inside the machine compartment S2.

Although not illustrated here, the machines, refrigerant pipes, and/or other refrigerant circuit-configuring parts in addition to the compressor 21 also are disposed inside the machine compartment S2.

(2) Detailed Configuration of Outdoor Fan

Figure 3:
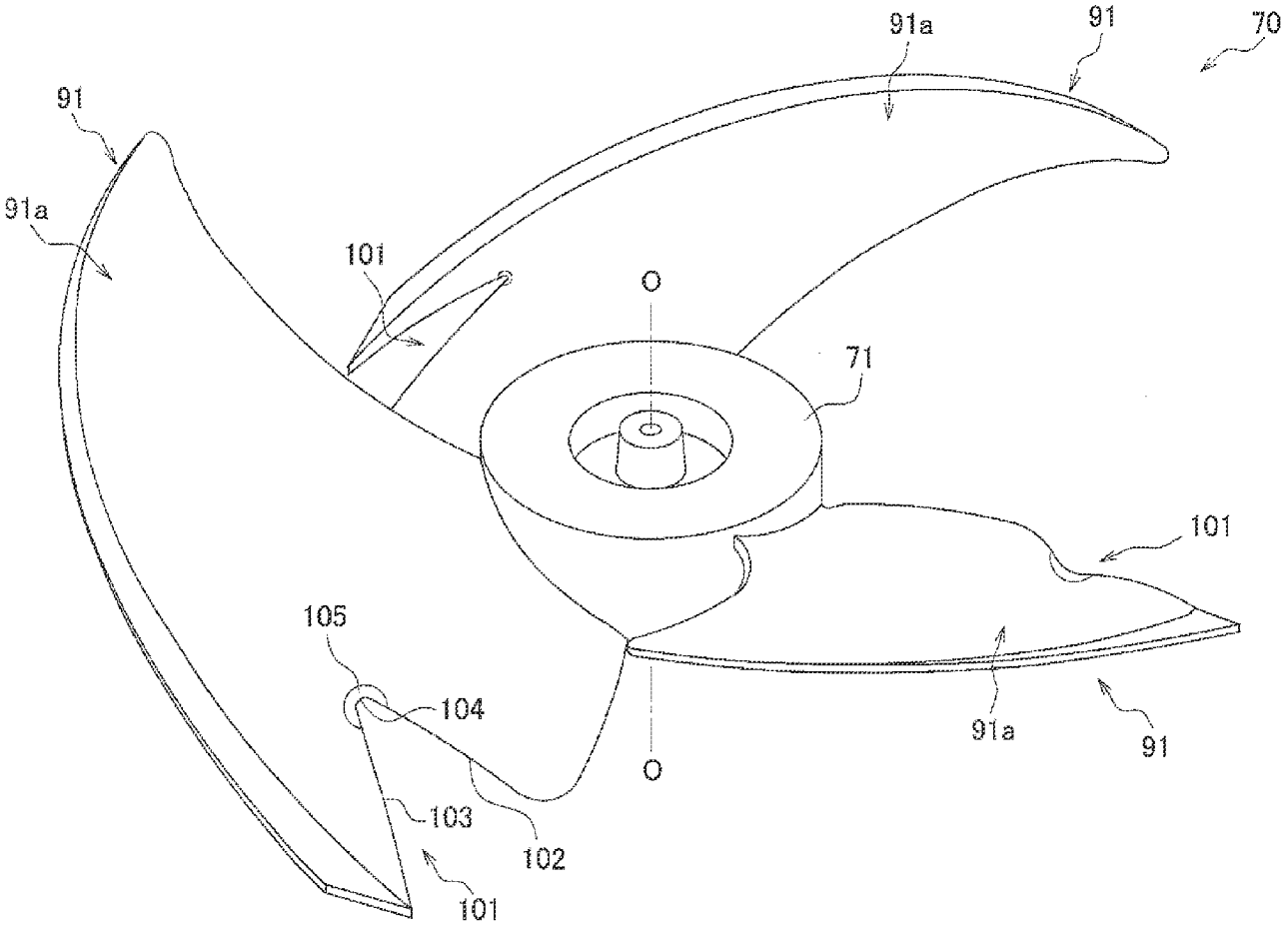
FIG. 3 is a perspective view of the outdoor fan according to an embodiment of the present invention.
Figure 4:
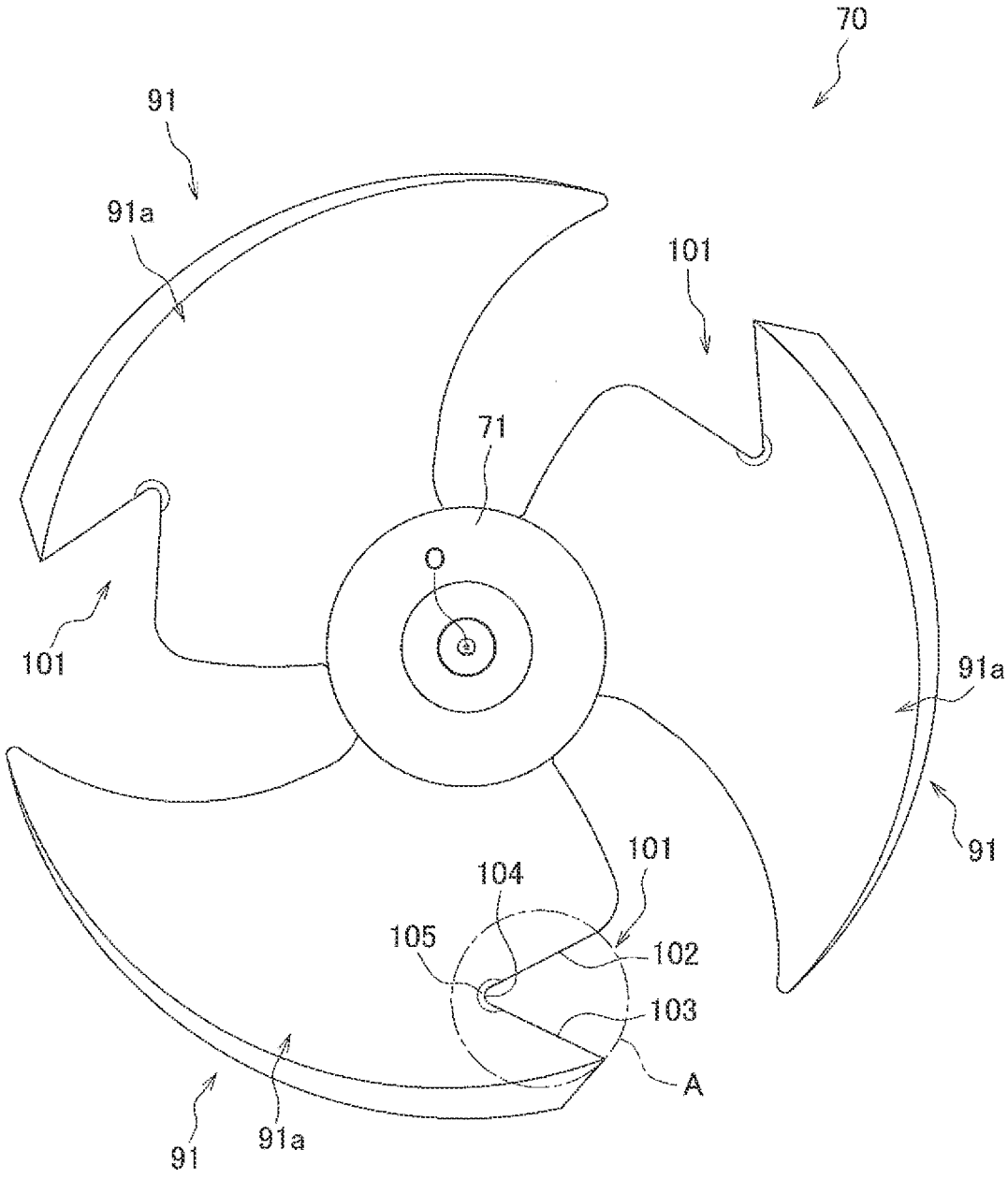
FIG. 4 is a plan view of a negative pressure face side of the outdoor fan according to an embodiment of the present invention.
Figure 5:
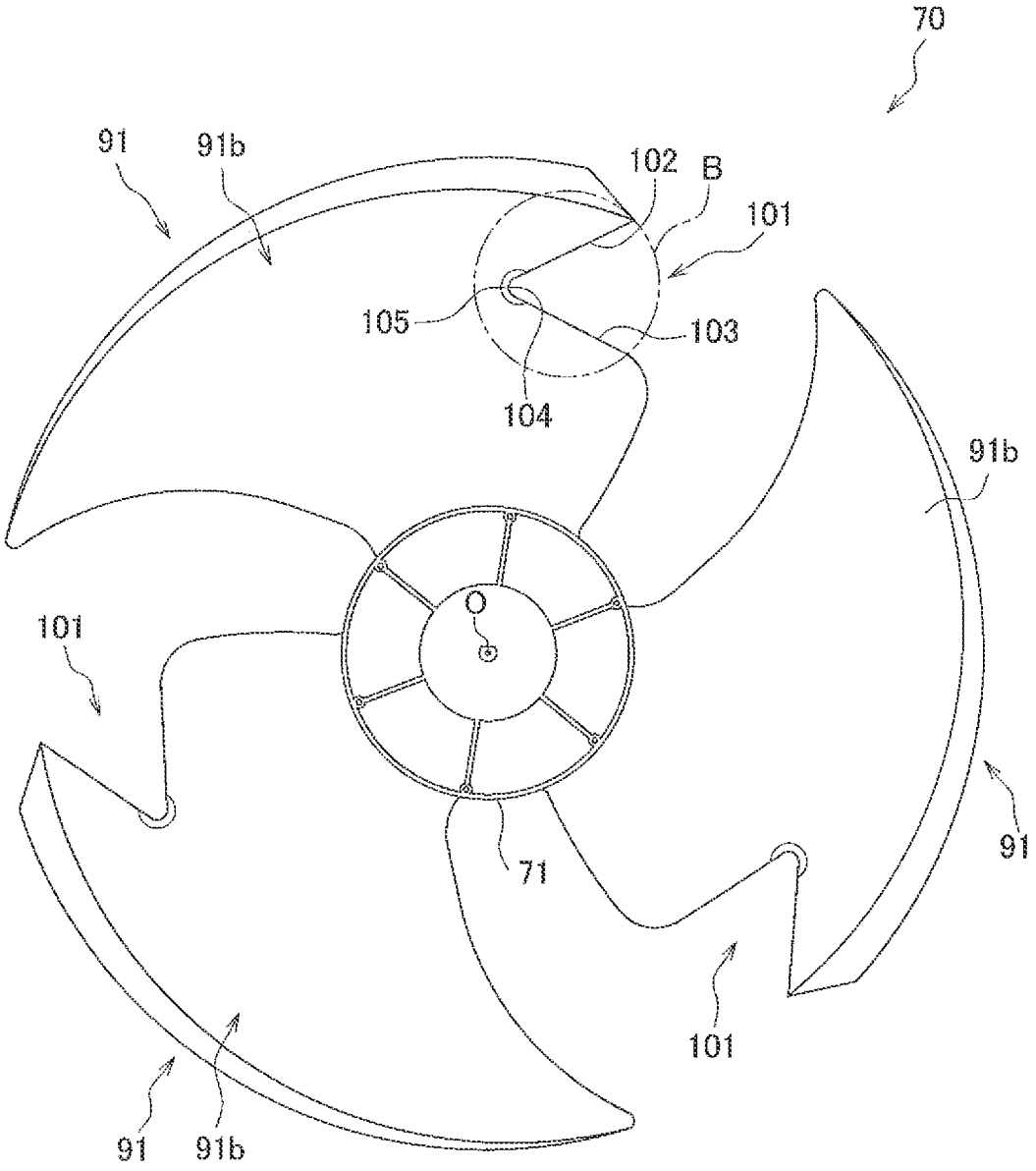
FIG. 5 is a plan view of a positive pressure face side of the outdoor fan according to an embodiment of the present invention.
Figure 6:
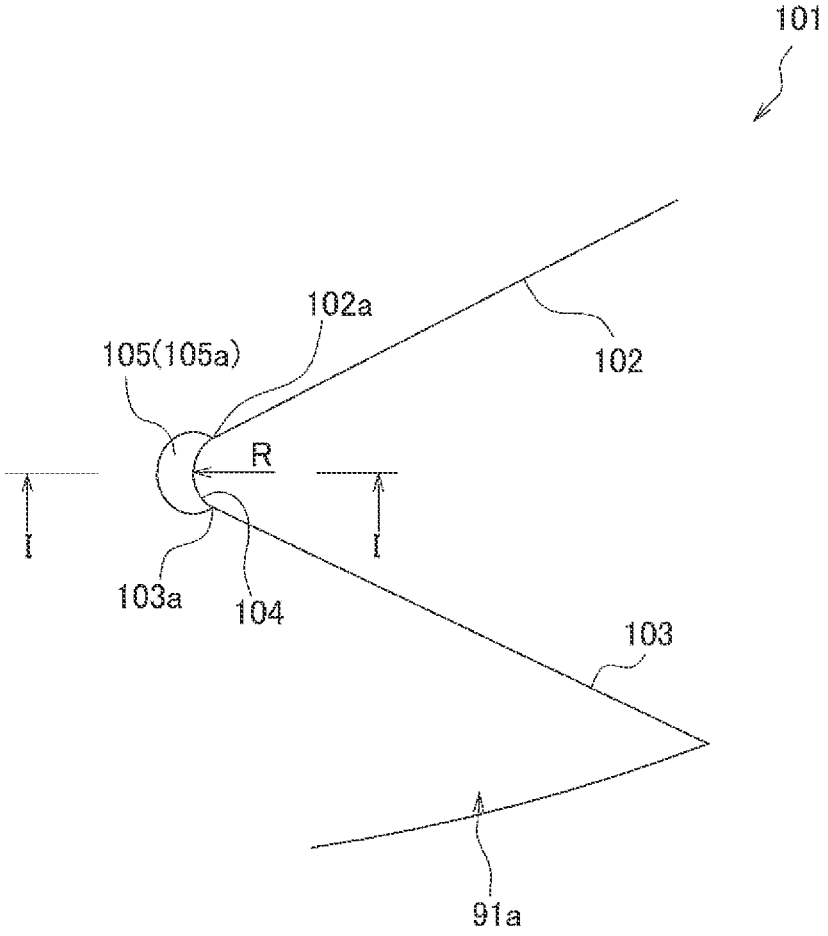
FIG. 6 is an enlarged view of area A of FIG. 4.
Figure 7:
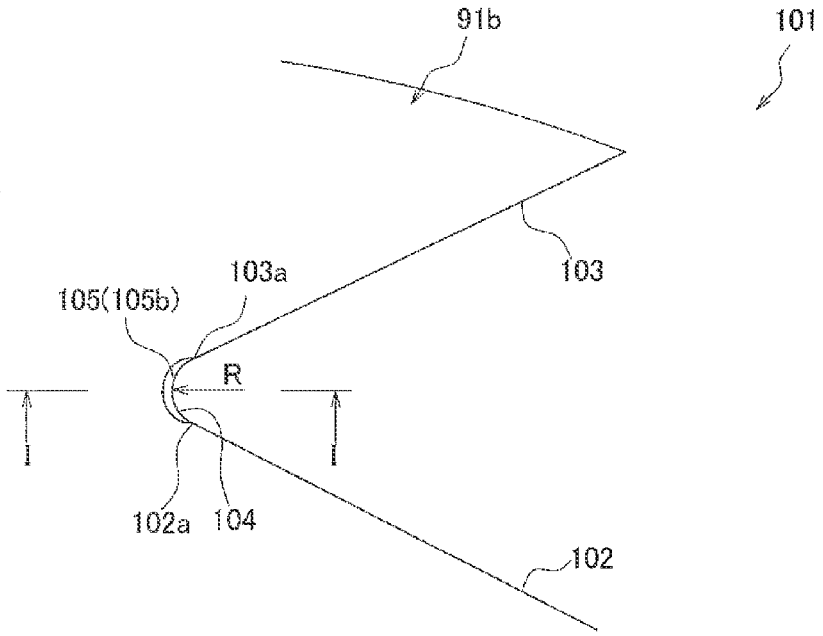
FIG. 7 is an enlarged view of area B of FIG. 5.
Figure 8:
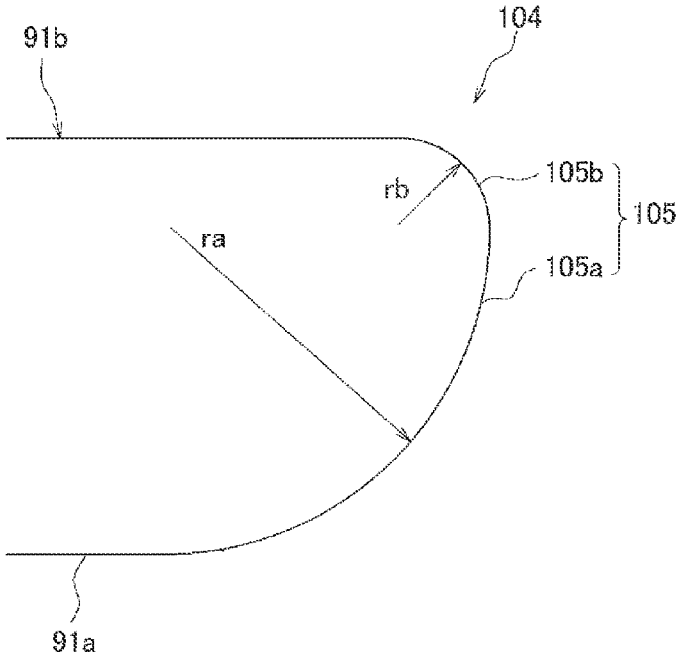
FIG. 8 is a cross-sectional view along I-I in FIGS. 6 and 7.

Next, FIGS. 3 to 8 are used to describe the detailed configuration of the outdoor fan 70 as an axial-flow fan according to the present embodiment. FIG. 3 is a perspective view of the outdoor fan 70. FIG. 4 is a plan view of the negative pressure face side of the outdoor fan 70. FIG. 5 is a plan view of the positive pressure face side of the outdoor fan 70. FIG. 6 is an enlarged view of area A of FIG. 4. FIG. 7 is an enlarged view of area B of FIG. 5. FIG. 8 is a cross-sectional view along I-I in FIGS. 6 and 7. In the following descriptions, the axial center (rotational center) of the outdoor fan 70 is denoted as the axial center O, and the axis thereof is denoted as the rotational axis O-O. The direction along the rotational axis O-O is denoted as the axial direction, the state of the outdoor fan 70 seen from the axial direction is denoted as a plan view, and the direction orthogonal to this plan view (i.e. the direction of viewing a cross section of the outdoor fan 70 cut along the rotational axis O-O) is denoted as a cross-sectional view.

The outdoor fan 70 is a propeller fan in which primarily the hub 71 and a plurality (here, three) of the blades 91 are integrally resin-molded, the blades being formed so as to project from the outer perimeter edge of the hub 71, as described above. The number of blades 91 is not limited to three, and may be four or more, for example.

The blades 91 have blade shapes that advance forward and tilt forward. The thickness of the blades 91 is greatest in the joints with the hub 71, and decreases toward the outer perimeter. The recessed parts 101 formed in the rear edges of the blades 91 are disposed nearer to the outer perimeter than the joints. When the outdoor fan 70 is rotated, the surfaces of the sides where air flows in (the upstream sides in the air flow direction) are denoted as the negative pressure surfaces 91*a*, and the opposite sides (the downstream sides in the air flow direction) are denoted as the positive pressure surfaces 91*b*.

The recessed parts 101 are V-shaped recesses. Specifically, in a plan view of the blades 91, the recessed parts 101 have primarily two linear parts 102, 103 leading from the rear edges toward the front edges of the blades 91, and curved parts 104 joining the end parts 102*a*, 103*a* together in the front edges of the two linear parts 102, 103. The inner perimeter linear parts 102 are substantially linear portions that constitute the sides near the inner perimeters of the V shapes of the recessed parts 101. The outer perimeter linear parts 103 are substantially linear portions that constitute the sides near the outer perimeters of the V shapes of the recessed parts 101. The curved parts 104 are portions corresponding to the apexes of the two linear parts 102, 103. The curved parts 104 are curved so as to protrude toward the front edges from the end parts 102*a*, 103*a* in the front edges of the linear parts 102, 103. The curved parts 104 herein have rounded shapes with a radius R.

When the outdoor fan 70 composed of such an axial-flow fan is rotatably driven by the fan motor 89, the centrifugal force during rotation causes deformation such that the blades 91 stretch toward the outer perimeter. At this time, stress readily concentrates in the recessed parts 101. The portions of the recessed parts 101 where stress concentrates most readily are the front-edge-side edge parts, which herein are the curved parts 104 corresponding to the apexes of the two linear parts 102, 103. Therefore, to minimize stress concentration in the recessed parts 101, it is most effective to relieve the stress in the curved parts 104 as front-edge-side edge parts.

In view of this, in the outdoor fan 70, rounded stress-relieving parts 105 are formed in the front-edge-side edge parts of the recessed parts 101 (the curved parts 104 herein), in the positive pressure surface 91*b* sides and the negative pressure surface 91*a* sides in a cross-sectional view of the blades 91. The stress-relieving parts 105 have negative pressure surface-side stress-relieving parts 105*a* in the negative pressure surface 91*a* sides, and positive pressure surface-side stress-relieving parts 105*b* in the positive pressure surface 91*b* sides. The negative pressure surface-side stress-relieving parts 105*a* have rounded shapes with a radius ra, and the positive pressure surface-side stress-relieving parts 105*b* have rounded shapes with a radius rb.

In the outdoor fan 70, stress in the front-edge-side edge parts of the recessed parts 101 (the curved parts 104 herein) can thereby be relieved, and stress concentration in the recessed parts 101 can be minimized.

In the stress-relieving parts 105, the radii ra and rb are preferably 1 mm or greater to expressly achieve the effect of relieving stress. In a case of two outdoor fans having the same blade diameter and/or blade thickness, wherein stress-relieving parts 105 having radii ra and rb of 1 mm or greater are formed in one and stress-relieving parts 105 are not formed in the other, for example, when stress analysis is performed in the recessed parts 101, the outdoor fan having stress-relieving parts 105 formed therein yields the effect of a stress reduction of 20% or more in the recessed parts 101 in comparison to the outdoor fan not having stress-relieving parts 105 formed therein.

In the outdoor fan 70, the rounded shapes in a plan view of the blades 91 of the curved parts 104 as front-edge-side edge parts have a radius of 8 mm or greater. Stress in the front-edge-side edge parts can thereby be further relieved, and stress concentration in the recessed parts 101 can be further minimized.

(3) Modifications

In the outdoor fan 70 of the above embodiment (see FIGS. 3 to 8), the stress-relieving parts 105 are formed only in the curved parts 104 as front-edge-side edge parts of the recessed parts 101, which are the most effective for suppressing stress concentration. However, the stress-relieving parts 105 are not limited to the curved parts alone and may also be formed in the linear parts 102, 103.

Figure 9:
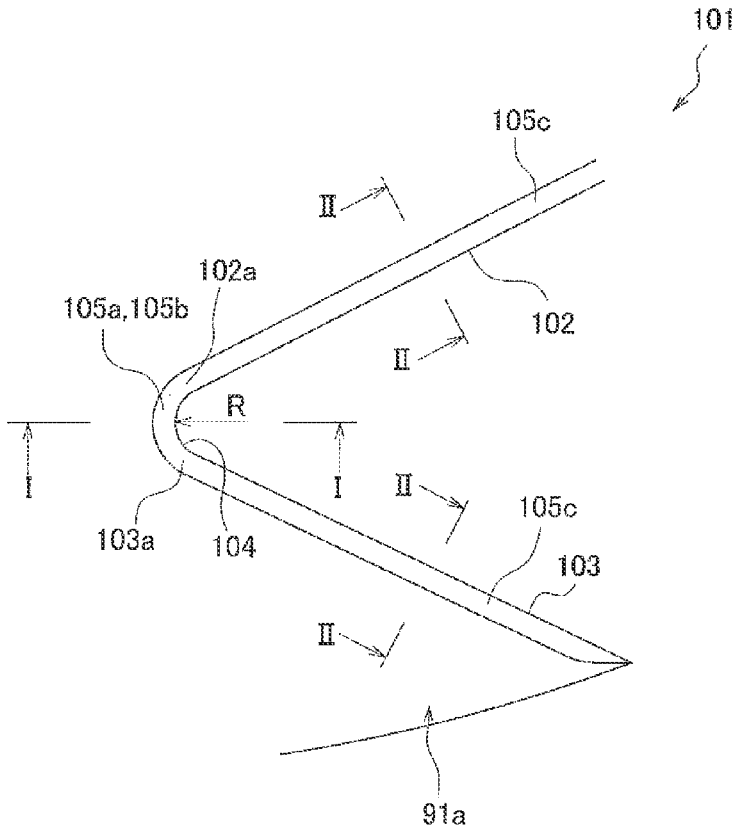
FIG. 9 is an enlarged view of a recessed part of an outdoor fan according to a modification, corresponding to FIG. 6.
Figure 10:
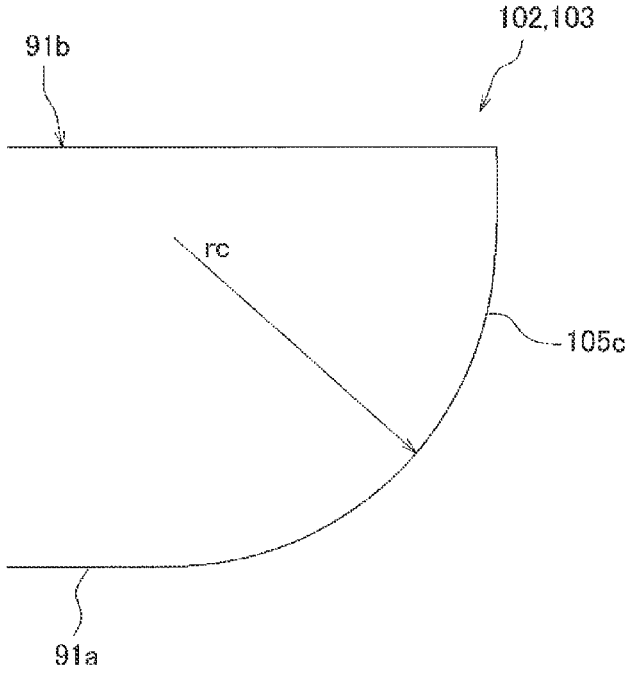
FIG. 10 is a cross-sectional view along II-II in FIG. 9, showing a stress-relieving part formed in a linear part of the outdoor fan according to the modification.

For example, stress-relieving parts 105*a*, 105*b* may be formed in the curved parts 104 as front-edge-side edge parts, and linear part-side stress-relieving parts 105*c* may be formed in the negative pressure surface 91*a* sides of the linear parts 102, 103, as shown in FIGS. 9 and 10. The stress-relieving parts 105*c* have rounded shapes of a radius rc, formed so as to be continuous with the negative pressure surface-side stress-relieving parts 105*a* formed in the negative pressure surface 91*a* sides of the curved parts 104.

It is thereby possible in the outdoor fan 70 of the present modification to further minimize stress concentration in the recessed parts 101, because stress-relieving parts 105 are formed not only in the curved parts 104 as front-edge-side edge parts but also in the linear parts 102, 103.

INDUSTRIAL APPLICABILITY

The present invention is widely applicable in an axial-flow fan having blades in which recessed parts that are recessed toward the front edges are formed in the rear edges.

What is claimed is:

1. An axial-flow fan having a blade with a recessed part that is recessed toward a front edge being formed in a rear edge of the blade, a rounded stress-relieving part being formed in a positive pressure surface side and a negative pressure surface side of a front-edge-side edge part of the recessed part as seen in a cross-sectional view of the blade, the rounded stress-relieving part having a positive pressure surface side stress relieving part formed in the positive pressure surface side and a negative pressure surface side stress relieving part formed in the negative pressure surface side, and a radius of the positive pressure surface side stress relieving part being different than a radius of the negative pressure surface side stress relieving part.

2. The axial-flow fan according to claim 1, wherein the radius of the positive pressure surface side stress relieving part is smaller than the radius of the negative pressure surface side stress relieving part.

3. The axial-flow fan according to claim 1, wherein the radius of the positive pressure surface side stress relieving part is at least 1 mm, and the radius of the negative pressure surface side stress relieving part is at least 1 mm.

4. The axial-flow fan according to claim 3, wherein the radius of the positive pressure surface side stress relieving part is smaller than the radius of the negative pressure surface side stress relieving part.

5. The axial-flow fan according to claim 1, wherein the recessed part is a V-shaped recess.

6. The axial-flow fan according to claim 5, wherein when the blade is viewed from above, the recessed part has two linear parts leading from the rear edge toward the front edge of the blade, and a curved part joining end parts together at front edges of the two linear parts; and the front-edge-side edge part is the curved part.

7. The axial-flow fan according to claim 6, wherein the curved part has a rounded shape with a radius of at least 8 mm when the blade is viewed from above.

8. The axial-flow fan according to claim 3, wherein the recessed part is a V-shaped recess.

9. The axial-flow fan according to claim 8, wherein when the blade is viewed from above, the recessed part has two linear parts leading from the rear edge toward the front edge of the blade, and a curved part joining end parts together at front edges of the two linear parts; and the front-edge-side edge part is the curved part.

10. The axial-flow fan according to claim 9, wherein the curved part has a rounded shape with a radius of at least 8 mm when the blade is viewed from above.

* * * * *